US007358904B2

(12) United States Patent
Prassmayer et al.

(10) Patent No.: US 7,358,904 B2
(45) Date of Patent: Apr. 15, 2008

(54) REMOTE-CONTROL DEVICE, PARTICULARLY REMOTE-CONTROL CENTRAL LOCK FOR MOTOR VEHICLES

(75) Inventors: Peter Prassmayer, Grosskarolinenfeld (DE); Gunther Mossmer, Wiedergeltingen (DE); Mohamed Slimani, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 734 days.

(21) Appl. No.: 10/505,977

(22) PCT Filed: Dec. 5, 2002

(86) PCT No.: PCT/EP02/13812

§ 371 (c)(1),
(2), (4) Date: Aug. 27, 2004

(87) PCT Pub. No.: WO03/073447

PCT Pub. Date: Sep. 4, 2003

(65) Prior Publication Data

US 2005/0146465 A1 Jul. 7, 2005

(30) Foreign Application Priority Data

Feb. 28, 2002 (DE) ..... 202 03 188 U

(51) Int. Cl.
*H01Q 1/24* (2006.01)

(52) U.S. Cl. ..... 343/702; 343/711

(58) Field of Classification Search ..... 343/702, 343/711, 713

See application file for complete search history.

(56) References Cited

U.S. PATENT DOCUMENTS

| | | | | |
|---|---|---|---|---|
| 5,596,234 | A | 1/1997 | Umeda et al. | |
| 6,392,610 | B1 * | 5/2002 | Braun et al. | 343/876 |
| 6,417,810 | B1 | 7/2002 | Huels et al. | |
| 2001/0045909 | A1 | 11/2001 | Egglestron | |
| 2002/0140607 | A1 * | 10/2002 | Zhou | 343/700 MS |

(Continued)

FOREIGN PATENT DOCUMENTS

DE 197 13 929 A1 11/1997

(Continued)

OTHER PUBLICATIONS

Official Action from related EPO application, p. 1 (Jul. 17, 2007).

(Continued)

*Primary Examiner*—Trinh Vo Dinh
(74) *Attorney, Agent, or Firm*—Nixon & Vanderhye P.C.

(57) ABSTRACT

A remote-control device, particularly a remote-control central lock for motor vehicles, comprising an electrical device which is preferably mounted in a housing and an antenna. The inventive remote-control device is further characterized by the following: the antenna is configured a) as a bendable antenna that is dimensionally stable in the bent shape, and/or b) as a stiff antenna, and/or c) as an antenna which is fixed to and maintained above a rigid and/or dimensionally stable base or housing; and the antenna is in a predefined position relative to the electrical device and/or the housing receiving or the base supporting said electrical device; and the electrical device and the antenna are embodied as a as a combined device in the form of an assembly operated as a single unit.

7 Claims, 4 Drawing Sheets

U.S. PATENT DOCUMENTS

Figure 1:
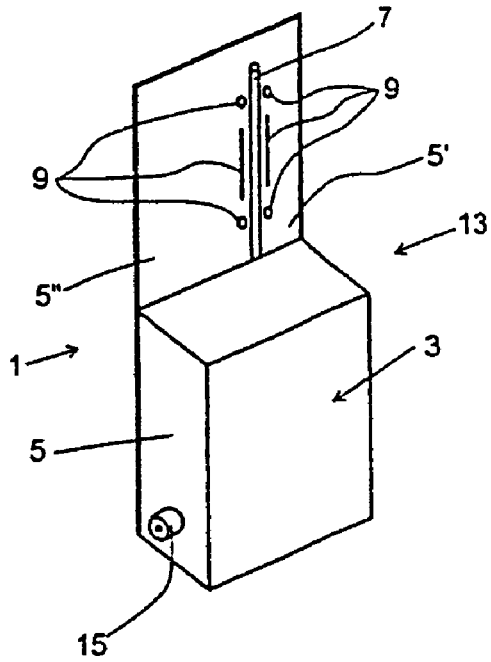

| | | | | |
|---|---|---|---|---|
| 2007/0063904 | A1* | 3/2007 | Chen et al. | 343/702 |
| 2007/0080871 | A1* | 4/2007 | Ying | 343/702 |

FOREIGN PATENT DOCUMENTS

| | | | |
|---|---|---|---|
| DE | 199 12 674 | A1 | 10/2000 |
| DE | 199 25 127 | C1 | 11/2000 |
| EP | 1 058 338 | A2 | 12/2000 |
| EP | 1 201 514 | A1 | 5/2002 |
| WO | 01/81133 | A1 | 11/2001 |

OTHER PUBLICATIONS

Soras et al., "Analysis and Design of an Inverted-F Antenna Printed on a PCMCIA Card for the 2.4 Ghz ISM Band," IEEE Antennas and Propagation Magazine, IEEE Service Center, Piscataway, NJ, US, vol. 44, No. 1, pp. 37-44, XP11092535 ISSN: 1045-9243 (Feb. 2002).

Anonymous, "Planar inverted-f antenna (PIFA) printed on circuit board," Research Disclosure, Mason Publications, Hampshire, GB, vol. 432, No. 67, XP007125922 ISSN: 0374-4353 (Apr. 2000).

* cited by examiner

REMOTE-CONTROL DEVICE, PARTICULARLY REMOTE-CONTROL CENTRAL LOCK FOR MOTOR VEHICLES

This application is the US national phase of international application PCT/EP02/13812 filed 05 Dec. 2002, which designated the US and claims priority to DE Application No. 202 03 188.8 filed 28 Feb. 2002. The entire contents of these applications are incorporated herein by reference.

The invention relates to a remote-controlled device, in particular a remote-controlled central locking system for motor vehicles as claimed in the preamble of claim 1.

Such antenna arrangements for a radio remote-controlled locking system in a motor vehicle are known to be arranged, for example, in the region of a window opening.

However, other installation locations are also possible and conceivable. At the manufacturer's works, the corresponding electronic devices are dispatched accommodated with their components in a housing, specifically together with an antenna. The antenna is generally embodied as a plug-part which can be plugged into the housing. When the antenna is installed, it is then usually routed in the vehicle in the form of a freely routable wire in such a way that, according to the general state of knowledge, the best possible reception effect is produced.

The object of the present invention is to improve such a remote-controlled device, in particular a remote-controlled central locking system.

The object is achieved according to the invention in accordance with the features specified in claim 1. Advantageous refinements of the invention are specified in the subclaims.

It has now become apparent that by installing the remote-controlled devices which were previously commercially available, severe fluctuations with respect to the reception power are found. One of the most important causes of this are the antenna elements which are routed differently when the antenna is installed, said elements being preferably in the form of wires which give rise to different reception powers depending on the routing direction. This applies especially also to the subsequent installation of such devices.

In comparison with the above, the invention uses comparatively simple means to bring about a significant improvement, which was not predictable in such a form.

It has namely been found that, in comparison with the prior art, not only are significantly improved reception powers possible with the device according to the invention but, above all, there are also no disadvantageous statistical "stray values in the downward direction", that is to say installation cases in which the reception powers drop significantly in comparison with other motor vehicles under specific conditions.

The solution according to the invention lies essentially in the fact that the electronic module, i.e. the remote-controlled device, is accommodated on a carrier or a housing as according to the prior art, but that a dimensionally stable or rigid antenna is used now, said antenna being inherently stable or being secured or formed on a rigid or dimensionally stable carrier. In this context it would be perfectly conceivable for the antenna in itself to be bendable, but also to be composed of dimensionally stable material, that is to say not like a flexible wire which is not dimensionally stable. However, it is also possible to use a flexible wire as the antenna if said wire is secured or routed at least on a carrier in such a way that it can ultimately be referred to as an antenna which has overall dimensional stability. This is because at the works of the motor vehicle manufacturer, the antennas are all routed in the same way over the electronic device when the electronic device is installed in a correctly positioned fashion.

In addition, it is preferable that the antenna cannot be connected to the device as a plug-module but can instead be securely and permanently connected to the device. As a result, a compact assembly is formed, which can be handled as a single unit and in which the antenna comes to rest in a fixed spatial assignment with respect to the module and therefore the same installation conditions can always be implemented in situ.

In one preferred embodiment, the antenna is routed, or formed, along the carrier or housing in a predetermined path. In this context, the antenna can preferably be routed so as to extend around parts of the carrier or housing, for example in the manner of a U in plan view.

However, carrier materials on which the antenna is not secured, mounted or routed on the carrier as a separate component are also conceivable. Instead, it is also possible for the antenna to be formed, for example, on a carrier material in the manner of a substrate so that it is permanently connected thereto, for example in the form of a strip conductor arrangement. The strip line can, if appropriate, be formed here so as to follow different paths, comparable, for example, with a zigzag structure or comparable with a square-wave pulse, that is to say formed so as to extend in an, as it were, meandering shape.

Finally, coil-shaped antennas, which are preferably secured to a carrier which penetrates the coil-shaped turns or secures them on the outside are, however, also perfectly conceivable.

A number of important advantages can be implemented by the present invention:

According to the invention, only a single combination device which can be handled jointly is necessary, said device being composed of the actual device which comprises the electronic components, for example the receiver and the antenna. The installation time in situ is therefore shortened.

Overall, as a result a compact design can thus be achieved, in particular if the antenna is formed so as to be routed bent around the housing of the remote-controlled device.

The connection between the antenna housing and antenna element is preferably formed without an additional plug-type connection or as a radio frequency line, as a result of which additional losses are avoided and the probability of failure as a result of a defective cable or a defective plug is also reduced.

In addition, according to the invention, a defined position of the antenna and thus a constant electrical radio frequency property in comparison with conventional solutions is obtained.

Furthermore, the remote-controlled device according to the invention also avoids rattling noises of the antenna since the antenna cannot strike against parts of the bodywork of the vehicle when the vehicle vibrates.

Finally, there is, however, also no need for a further radio frequency line in the cable harness.

Figure 2:
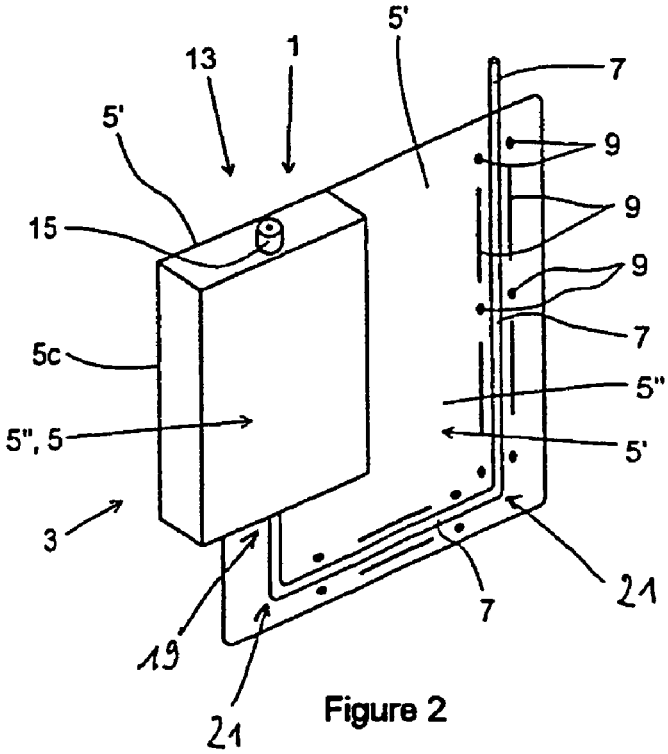
Figure 3:
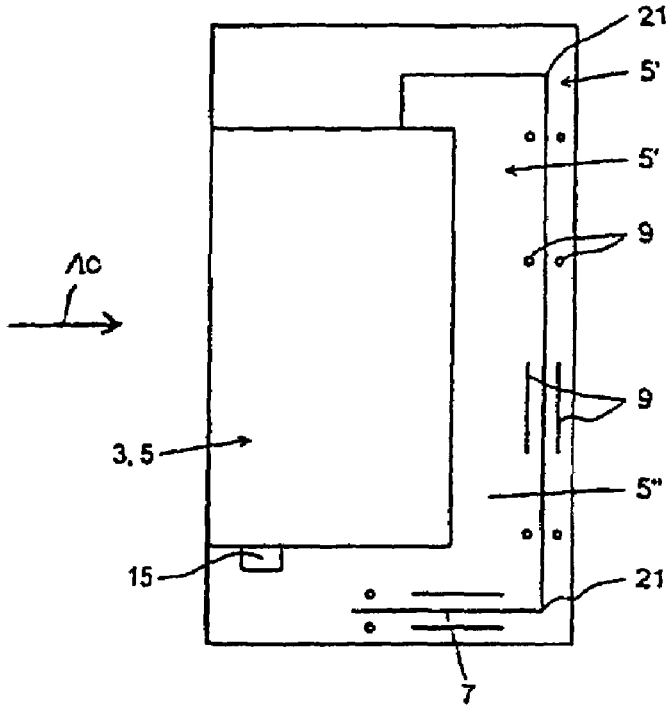
Figure 3A:
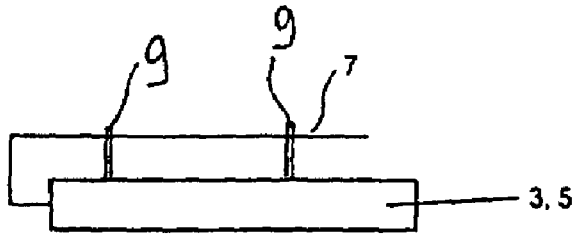
Figure 3B:
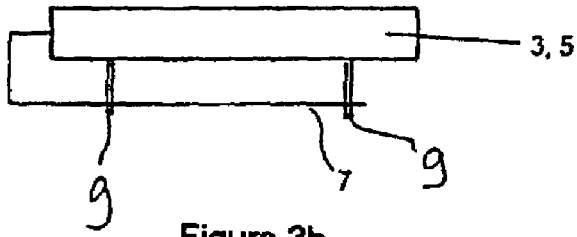

Further advantages, details and features of the invention result below from the exemplary embodiment which is illustrated with reference to drawings, in which, in particular:

FIG. 1: shows a schematic, perspective view of a first exemplary embodiment, FIG. 2: shows a further perspective view of a modified exemplary embodiment;

FIG. 3: shows a schematic direct view of an exemplary embodiment which is slightly modified still further with respect to FIG. 2;

FIG. 3*a:* shows a side view of an exemplary embodiment which is slightly modified with respect to FIG. 3;

FIG. 3*b:* shows an exemplary embodiment which is slightly modified even further with respect to FIG. 3*a;*

Figure 4:
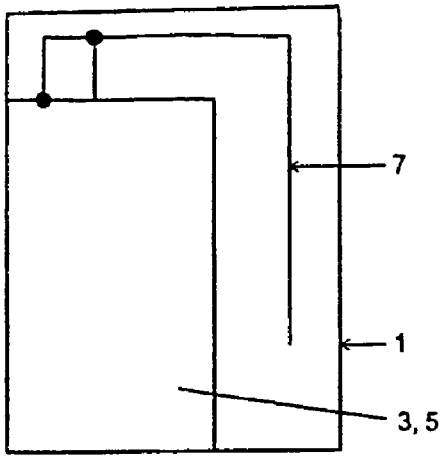
Figure 5:
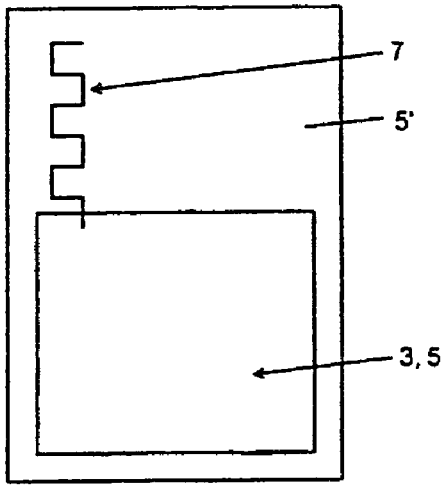
Figure 6:
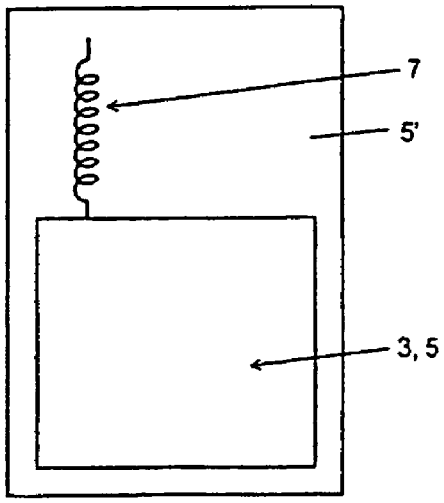
Figure 7:
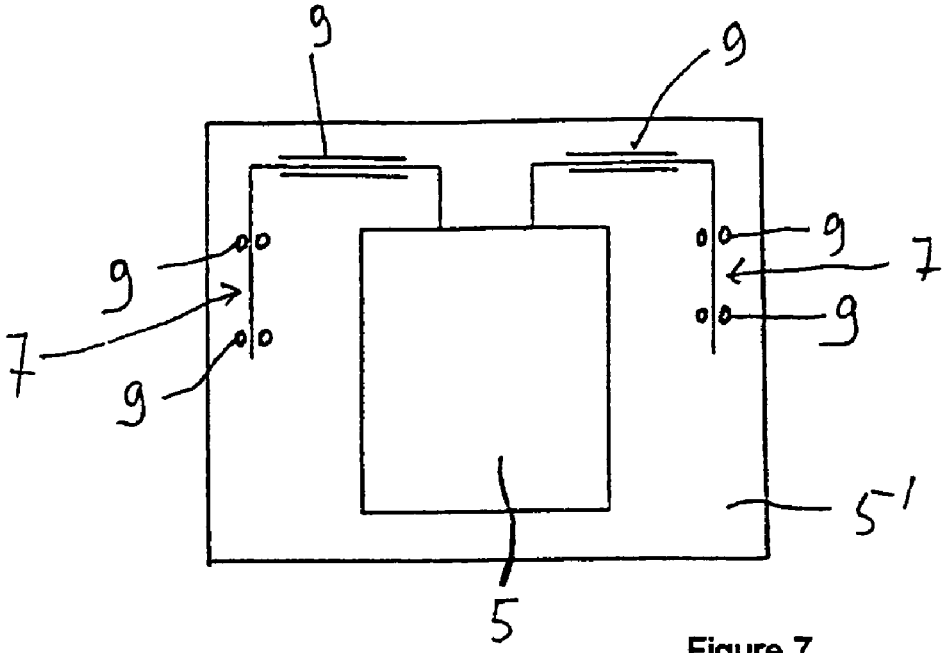
Figure 8:
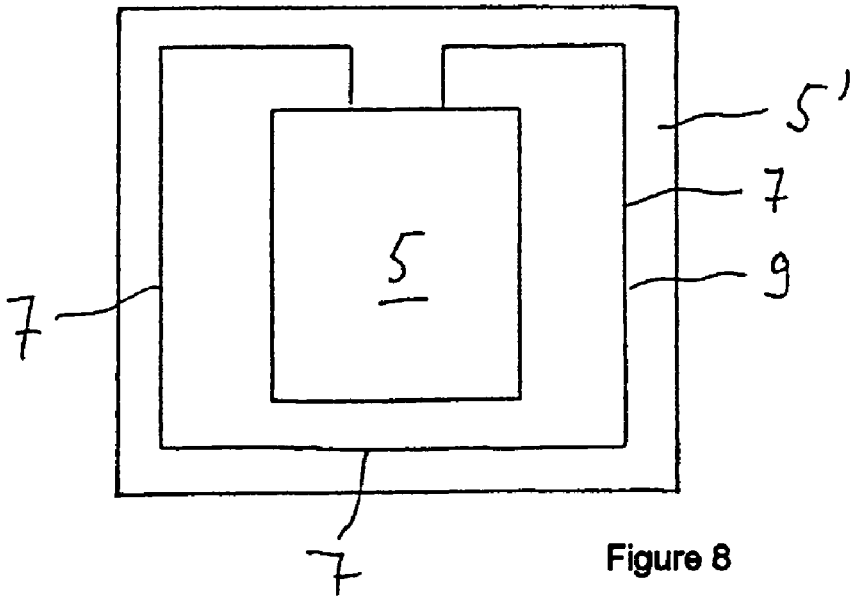

FIG. 4: shows the modified exemplary embodiment with in an inverted F antenna;

FIG. 5: shows an exemplary embodiment which is modified even further with a structural antenna on a printed circuit board;

FIG. 6: shows a further modified exemplary embodiment with a coil;

FIG. 7: shows a schematically represented example with a dipole antenna; and FIG. 8: shows a further example with a loop antenna.

FIG. 1 shows a combination device 1—which shows a remote-controlled central locking system—in a schematically perspective view.

This combination device 1 is composed of an electrical device 3, i.e. in the exemplary embodiment shown, of a remote-controlled central locking system module 3, which is usually securely installed in a housing 5 or on a carrier 5'. Furthermore, the combination device 1 comprises an antenna 7 which can be composed, in the exemplary embodiment shown in a schematic plan view according to FIG. 1, of a wire, a stranded conductor or a tube, hollow tube etc. The antenna 7 is preferably introduced into the electrical device without plug-type contacts and placed in contact there electrically.

The entire arrangement of the electrical device 3 with its housing 5, which can also be embodied as a housing shell 5, is therefore provided or mounted with the antenna 7 on a common base plate 5', that is to say generally on a carrier 5'. This ensures that even if the antenna 7 were to be composed of a deformable wire or a stranded conductor, the antenna 7 can be permanently arranged, by means of securing elements 9 which are provided on the carrier or the base plate 5', with an orientation which is permanently predefined and extends linearly in the exemplary embodiment.

This results in an assembly 13 which can be handled overall jointly and as a single unit, for the combination device 1, and is composed of the actual electrical device component 3 and the antenna 7 which is permanently positioned in a fixed position and assignment.

This assembly 13 can then be correspondingly installed in a motor vehicle, a corresponding electrical connection being available for outputting the demodulated data signal by means of a connection 15 to the housing 5, in order to ultimately activate the central locking system, for example.

A modified exemplary embodiment is shown in the schematic, perspective illustration in FIG. 2. This results in a particularly compact structural arrangement with an antenna element 7 which is comparatively long in dimension, by virtue of the fact that, with respect to the electrical device 3, the antenna element 7 is routed in an, as it were, U shape around the housing 5 from an exit point 19, and to an illustrated exemplary embodiment according to FIG. 2 forming two approximately 90° bends 21.

In one preferred embodiment, the carrier 5 or the base plate 5' can also be part of a lid for the housing 5 for holding the electrical device 3. The carrying plate or base plate 5' is then given larger dimensions in the plan view than the actual housing 5 or the housing shell 5. As indicated in FIG. 3, this results in a section of the carrier or of the base plate 5' which protrudes laterally beyond the housing shell 5", over which the antenna 7 can then be routed in a permanently prepositioned fashion, for example in wire form or a stranded conductor. For this purpose, securing nipples 9 or webs 9 are also preferably provided again so that the wire is inserted here and permanently secured.

The schematic plan view according to FIG. 3 shows that the antenna element can also be routed, for example, around a further bend 21 at least a certain distance again along the end side of the housing.

FIGS. 3*a* and 3*b* show a modification with respect to FIG. 3. In FIG. 3, the antenna 7 is essentially routed on the longitudinal side of the housing 5 in parallel with this housing side on the carrying plate or base plate 5'. In FIG. 3*a,* a side view of the housing in the direction of the arrow 10 in FIG. 3 is represented, but with the difference with respect to FIG. 3 that in fact the antenna 7 on the upper side of the housing 5 is routed longitudinally with respect to the upper side. In the example according to FIG. 3*b,* the antenna is routed on the underside of the housing, once more corresponding nipples or webs 9 for securing the antenna or the antenna stranded conductor being in turn provided in these cases.

In the exemplary embodiment according to FIG. 4, an inverted F antenna 7 is used, the routing of the antenna element 7 otherwise corresponding largely to that example according to FIGS. 2 and 3.

FIG. 5 shows that the antenna 7 can also be formed as a strip conductor element or as a conductive antenna element which is left by etching, and which can have a very wide variety of forms, for example, on the base plate or carrier plate 5' which preferably consists of a printed circuit board. In the exemplary embodiment according to FIG. 6, a rectangular base structure, comparable to a meandering-shaped structure, is selected.

FIG. 6 illustrates merely that, for example, a wire coil is however also possible as antenna element. Said coil is preferably secured and fastened to a carrier or a base plate, in particular a printed circuit board. However, the coil element can equally well be secured by a carrier or the printed circuit board using a mandrel-like element which projects through the interior of the coil element.

FIG. 7 represents a modified exemplary embodiment in which the base plate 5' extends beyond the housing 5 on all sides with the result that a dipole antenna 7 can also be attached to this base plate 5'. The dipole antenna 7 which is composed again, for example, of wires or stranded conductors can also be secured by securing elements 9 (securing webs, securing knobs and the like).

In the exemplary embodiment according to FIG. 8, instead of a dipole antenna 7, a loop antenna has been used, which antenna is routed around the entire housing 5 on the base plate 5', and in which antenna the free dipole ends have therefore been connected, by means of a connecting section, to form a loop, as a supplement to the dipole antenna illustration according to FIG. 7. Further modifications are possible. In FIG. 8, the further securing elements on the base plate 5' for securing the antenna are not illustrated in more detail.

The invention claimed is:

1. A remote-controlled device, in particular a remote-controlled central locking system for motor vehicles, having an electrical device which is preferably accommodated in a housing, and having an antenna, having the following features:

the antenna is fastened to a secure and/or dimensionally stable carrier and secured above the carrier, the antenna is located in a position which is predefined with respect to the electrical device and/or in a position which is predefined with respect to the housing which receives the electrical device, or the carrier which secures the electrical device, and the electrical device and the antenna are embodied as a component which is handled as a single unit, in the form of a combination device, characterized by the following further feature:

the antenna is composed of an inverted F antenna, the inverted F antenna is formed from a wire or a stranded conductor or as a remaining conductive layer on a printed circuit board, the carrier is composed of a base plate, and the inverted F antenna is formed on the base plate so as to extend in a position parallel thereto.

2. The radio-controlled device as claimed in claim 1, characterized in that the antenna and the electrical device are connected permanently without plug-type contacts.

3. The radio-controlled device as claimed in claim 1, characterized in that a carrier or the base plate project beyond the housing, and in that the inverted F antenna is provided on the carrier which projects beyond the housing or on the section of the base plate which projects beyond the housing.

4. The radio-controlled device as claimed in claim 1, characterized in that securing elements, by means of which the inverted F antenna which is in wire form is positioned in a strictly predefined position and secured, are formed on the housing and/or carrier or on the base plate.

5. The radio-controlled device as claimed in claim 1, characterized in that the inverted F antenna comprises, in plan view, in an antenna section which is routed in a U-shape at least round parts of the housing at a distance therefrom.

6. The remote-controlled device as claimed in claim 1, characterized in that the inverted F antenna is embodied as a conductor track on a printed circuit board.

7. The remote-controlled device as claimed in claim 3, characterized in that the carrier or the base plate is formed by the printed circuit board on which the inverted F antenna is formed.

* * * * *